United States Patent [19]

McAdams

[11] Patent Number: 5,050,738

[45] **Date of Patent: * Sep. 24, 1991**

[54] FIREWOOD PACKAGE

[76] Inventor: William J. McAdams, 3006R N. Main St., Ft. Worth, Tex. 76106

[ * ] Notice: The portion of the term of this patent subsequent to Nov. 14, 2006 has been disclaimed.

[21] Appl. No.: 432,890

[22] Filed: Nov. 7, 1989

Related U.S. Application Data

[63] Continuation-in-part of Ser. No. 183,093, Apr. 20, 1988, Pat. No. 4,879,861.

[51] Int. Cl.[5] ..... B65D 65/00

[52] U.S. Cl. ..... 206/497; 206/83.5; 206/499; 53/435

[58] Field of Search ..... 206/83.5, 204, 497, 206/597, 321, 322, 499, 600; 34/38; 53/390, 435; 100/3

[56] References Cited

U.S. PATENT DOCUMENTS

| | | | |
|---|---|---|---|
| 242,369 | 5/1881 | Ritter, Jr. | 206/83.5 |
| 2,075,023 | 3/1937 | David | 206/83.5 |
| 2,103,649 | 12/1937 | Sullivan | 206/322 |
| 2,833,403 | 5/1958 | Benschoter | 206/83.5 |
| 3,253,707 | 5/1966 | Gooding | 206/597 |
| 3,508,375 | 4/1970 | Myers | 206/497 |
| 3,638,790 | 2/1972 | Schmid et al. | 206/497 |
| 3,809,223 | 5/1974 | Kendall | 206/497 |
| 3,944,070 | 3/1976 | Cardwell et al. | 206/497 |
| 4,036,364 | 7/1977 | Ambrose | 206/497 |
| 4,289,237 | 9/1981 | Cutrara | 206/497 |
| 4,339,040 | 7/1982 | Peil et al. | 206/497 |
| 4,516,267 | 5/1985 | Kent et al. | 206/497 |
| 4,597,189 | 7/1986 | Cutrara | 206/497 |
| 4,700,528 | 10/1987 | Bernard | 206/497 |
| 4,763,787 | 8/1988 | Koenig | 206/600 |
| 4,815,603 | 3/1989 | Harris | 206/497 |
| 4,829,750 | 5/1989 | Cassidy | 53/390 |
| 4,879,861 | 11/1989 | McAdams | 53/435 |

OTHER PUBLICATIONS

Packaging, Aug. 1984, pp. 66-67 by Mobil Chemical Company.

*Primary Examiner*—David T. Fidei
*Attorney, Agent, or Firm*—Richard C. Litman

[57] ABSTRACT

A package of firewood and kindling material includes a plurality of layers of preferably split firewood lengths of equal axial extent and which are arranged in a manner to provide an extremely compact, high density unitized package exhibiting exceptional stability. The firewood is positioned on a square bottom support member in a multiplicity of cross-stacked layers, wherein each layer is positioned in substantially normal axial displacement to one another, thus providing lateral stability both during the packaging procedure and thereafter. A casing of shrink wrap material surrounds the stacked layers as well as the bottom support member, such that the shrink wrap may be heated to tightly encase the vertically positioned firewood, and included kindling material. The invention thereby provides a readily transportable and storable package of firewood along with a combustible material and which is suitable for either home or recreational use.

2 Claims, 2 Drawing Sheets

FIREWOOD PACKAGE

CROSS-REFERENCE TO RELATED APPLICATIONS

This application is a continuation-in-part application of my U.S. patent application Ser. No. 07/183,093 filed on Apr. 20, 1988, now U.S. Pat. No. 4,879,861.

BACKGROUND OF THE INVENTION

1. Field of the Invention

The present invention relates to a unique assemply forming a package of firewood together with a material exhibiting greater combustibility e.g., kindling and wherein a thermally shrinkable plastic envelope or casing is placed over a plurality of layers of firewood. Each such layer is positioned in substantially normal axial displacement relative the next adjacent layer, thus providing omni-directional dimensional stability to the completed package.

Homeowners are increasingly becoming more aware of ways to conserve energy. This is in an attempt to more economically make use of their homes. Thus, the fireplace has been revived, as both an energy conserving tool and as a means for providing more aesthetic value to the home. Homeowners are using their fireplaces in greater numbers than ever, primarily in view of the dramatic increase in the cost of common sources of heating energy such as fuel oil, natural gas and electricity. For this reason, untold thousands of households now use the fireplace as a means of providing at least significant supplemental heating of the home, with or without the addition of a fireplace wood stove insert.

Splitting firewood is both time consuming and a cumbersome task, especially during seasons of inclement weather. Although split firewood is available, and may be stored in one's home or backyard, transporting and handling of individual pieces of split firewood generally results in undesirable results, e.g., splinters in the hands of the user, and unwanted or undesirable pieces of wood. Packaged firewood, generally available in single layers or round strapped bundles, is frequently unstable during storage of large quantities, and is normally accessible only in loose fitting containers. The storage of bulk delivered quantities of firewood, as in cord or half-cord lots, is not feasible for many users, particularly in the case of families residing in the now very popular townhouses or apartments which are equipped with fireplaces. in these instances, often the entire inventory of firewood must be maintained within the residence interior. This precludes the purchase, transport or otherwise handling and storage of large quantities of the firewood. Additionally, it presents an untidy and awkward situation for such inhabitants to separately cut and store appropriate kindling for the starting of the burning of the firewood.

Accordingly, it is highly desirable to have available relatively small, precise measurements of firewood and kindling and which are provided in extremely compact and clean packages that are convenient for ready transport, even by women and children.

2. Description of the Related Art

Various prior art methods and apparatus for packaging goods, as well as the method of their construction in general, are known and are found in the prior art.

U.S. Pat. No. 4,597,189 issued to Cutrara contemplates a process for curing green wood within a heat shrinkable thermoplastic netting, thus providing individual bags of palletized kiln dried firewood.

U.S. Pat. No. 4,575,989 issued to Hannen discloses a method and apparatus for packaging palletized stacks of goods which includes a conveyor device for transporting the respective pallets to a shrink station for individual wrapping.

U.S. Pat. No. 3,529,717 issued to McDougal discloses a palletized means of tightly heat shrinking a load of firewood to prevent lateral movement of its enclosed materials.

U.S. Pat. No. 4,500,001 issued to Daniels discloses a method and apparatus for packaging a stack of articles comprising providing a vertical support and a pallet upon which layers of articles are placed. A shrink wrap cover is then provided.

U.S. Pat. No. 4,220,431 issued to Place et al. discloses a vertical support and a base for packaging a stack of articles. The vertical support has a removable truss member.

These patents, or known prior art uses, teach and disclose various methods and apparatus for packaging goods of various manufactures, and the like, as well as methods of their construction; but none of them, whether taken singly or in any combination, are seen to disclose the specific details of the combination according to the present invention in such a way as to bear upon the claims herein.

More specifically, none of the prior art patents disclose a package of split firewood, wherein the package includes a plurality of vertically positioned layers of constant length split firewood in normal axial displacement to one another, with a top layer of kindling and which is enveloped within a thermally shrinkable heat wrap material, thus limiting displacement of the contained firewood and kindling material during packaging, transport and storage thereof.

SUMMARY OF THE INVENTION

By the present invention, an improved package of firewood is presented and which comprises an extremely compact substantially cubic measure of split firewood and kindling that is inexpensive to manufacture. More particularly, the invention contemplates stacking and packaging equal sized lengths of split firewood within a heat shrinkable envelope or casing in such a manner so as to limit dimensional instability during packaging, transport and storage of same and to maximize the mass of material as contained therein. Also provided within the package is an uppermost layer of more highly combustible material, i.e., kindling, to be used as a fire starting agent.

Accordingly, an object of the present invention is to provide an improved package of multi-layers of split firewood together with an uppermost layer of kindling material.

It is another object of the present invention to provide a package of firewood including a heat shrinkable envelope or casing that enhances the dimensional stability or in other words, discourages the displacement of the contained firewood during movement and storage of the package.

It is a further object of the present invention to provide a package of firewood that deters infestation by insects and other pests.

Another object of the present invention is to provide a firewood package of substantially cubic configuration including a contained platform or base and that is easy to transport.

A further object of the present invention is to provide an improved package of firewood including cross-stacked multiple layers of equal length split firewood positioned upon a bottom platform with alternate layers disposed normal to one another and with an uppermost layer of kindling, with an enveloping casing of heat shrinkable material tightly bound about the stacked firewood and kindling and capturing the bottom platform to provide a rigid composite package easily carried and stored.

With these and other objects in view which will more readily appear as the nature of the invention is better understood, the invention consists in the novel construction, combination and arrangement of parts hereinafter more fully described, illustrated and claimed, with reference being made to the appended drawings.

BRIEF DESCRIPTION OF THE DRAWINGS

Similar reference characters designate corresponding parts throughout the several figures of the drawings.

DESCRIPTION OF THE PREFERRED EMBODIMENTS

Figure 1:
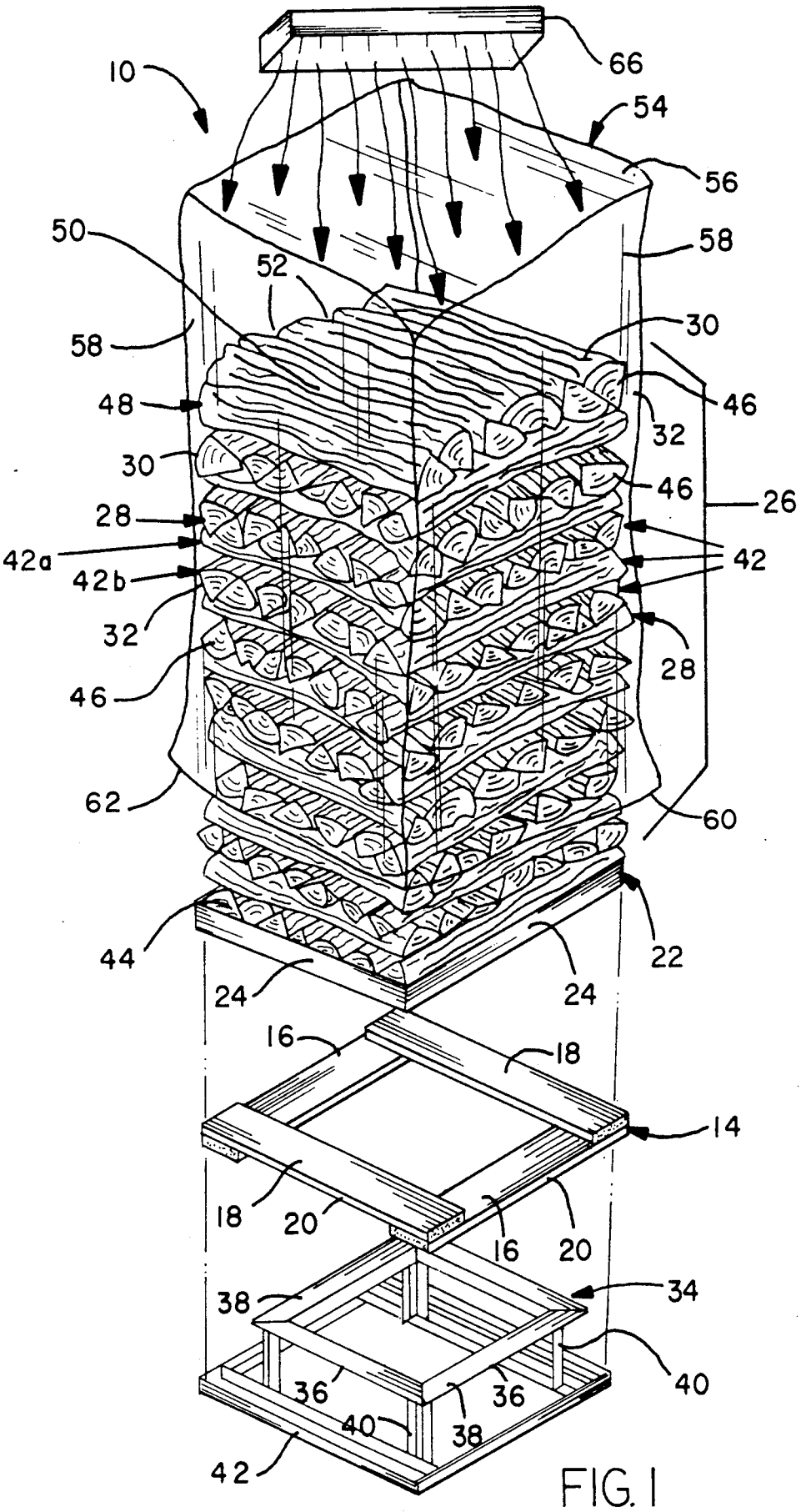
FIG. 1 is an exploded perspective view of firewood as packaged according to the present invention.
Figure 3:
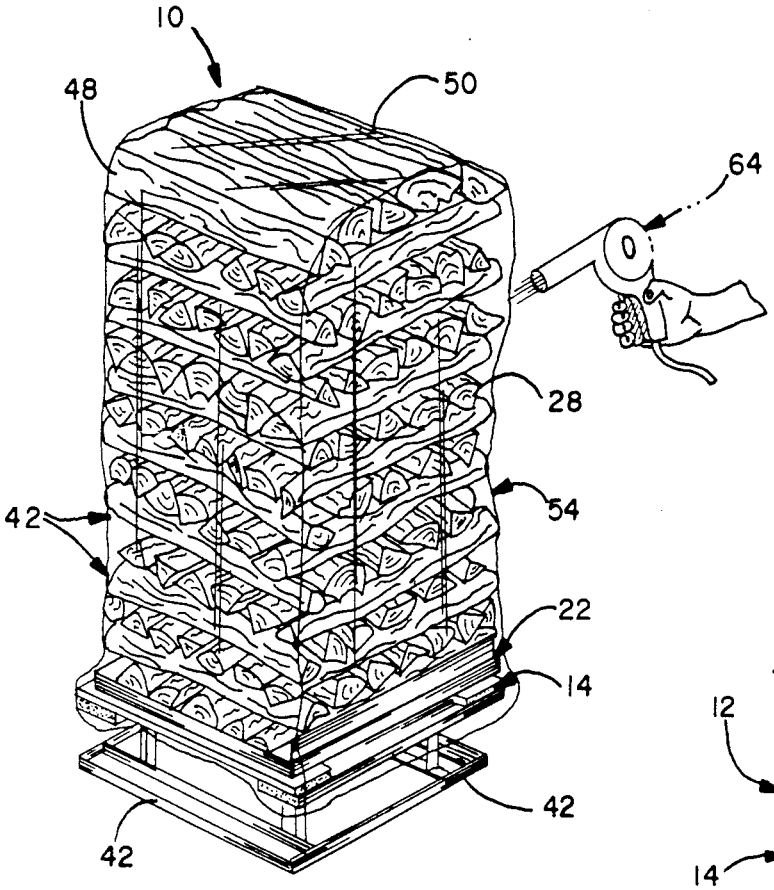
FIG. 3 is a perspective view illustrating one manner of heat shrinking the wrapper during the final step of forming the firewood package.
Figure 2:
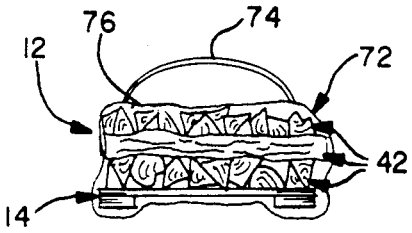
FIG. 2 is an end elevation of an alternative firewood package.
Figure 4:
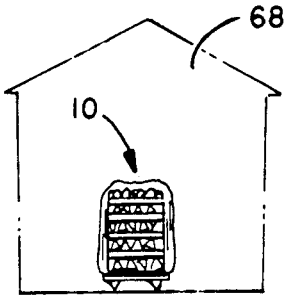
FIG. 4 is a front elevation showing another manner of heat shrinking the wrapper of the package.
Figure 5:
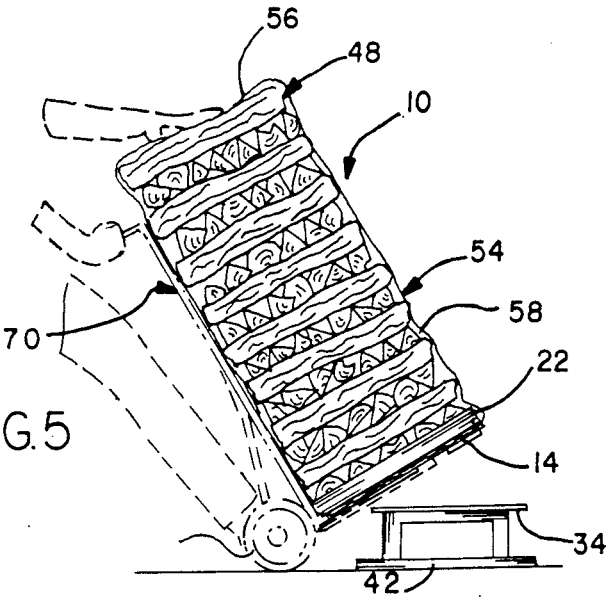
FIG. 5 is a side elevation illustrating one manner of removing the tightly encased firewood and kindling material package following its assembly.

Referring now to the drawings, the present invention will be understood to relate to a firewood package, generally designated 10 or 12 and as shown mostly clearly in FIG. 3 and 2, respectively. The construction and method of assembly of the two package embodiments is generally similar, with the primary distinction between the two comprising the volume or number of stacked layers of firewood. Each package includes a bottom support or retainer 14 as shown in FIG. 1 and which comprises a pair of opposed first side portions 16—16 affixed to a pair of opposed second side portions 18—18 in a manner to provide an outer periphery 20 difining a square. Alternatively, or in addition to the retainer 14, a tray 22 may be utilized and which likewise defines an outer periphery 24 presenting a square configuration.

The purpose of either the retainer 14 or tray 22 is to provide not only a bottom most substantially planar support for the stack 26 of firewood to be disposed thereatop but also, to serve as a guide member to properly orient the firewood as it is specifically stacked during the formation of the package. The firewood as employed in the instant packages is preferably split from logs so as to provide a plurality of split lengths 28, all of a common fixed length equal to that of one side of the square bottom support 14 or 22.

Generally, it is most economical to initially cross-cut logs into common length sections and thereafter, split the individual sections to provide a plurality of split lengths 28 each having an arcuate, outer bark surface 30 and at least one substantially planar, split surface 32. Depending upon the diameter of the starting log, two or more split lengths 28 may be derived from each section and accordingly, the resultant lengths will exhibit either one or two planar split surfaces 32. By utilizing split log sections to produce the packages of this invention, it will become apparent hereinafter that a most compact and stable assembly is achieved with a substantially consistent mass of firewood being formed in all packages of a similar height.

The firewood stack 26 preferably is formed with the bottom support 14 and/or 22 disposed atop an elevated platform 34 which again, defines an outer periphery 36 presenting a square configuration but wherein each side thereof is substantially shorter than any one side of the bottom support 14 or 22. The platform 34 may comprise four equal length rails 38 as shown in FIG. 1 or a coextensive plate (not shown) and which is elevated by standards 40 in turn affixed to a base 42. Thus, it will follow that the outer periphery 24 of the tray 22 and periphery 20 of the retainer 14 when resting upon the platform 34, will project laterally beyond the periphery 36 of the platform 34.

The stack is formed by cross-stacking a plurality of layers 42 of split lengths 28 upon one another, until the desired package height is attained. All split lengths of any one layer 42 are arranged with their longitudinal axes disposed substantially parallel. Thus, the split lengths 28 in one such layer **42*a* will have their axes disposed normal to the axes of the split lengths as located in the next adjacent layer 42*b* and this alternate arrangement follows throughout the vertical extent of the stack 26. Depositing the bottom layer 44 upon either the tray 22 or retainer 14 represents a critical phase of the assembly of the packages. All of the split lengths 28 are positioned so that their respective end surfaces 46 are substantially flush with the vertical planes passing through the adjacent peripheral surface 20 or 24 of the pallet 14 or tray 22. Accordingly, the peripheral surface of the bottom support will be understood to serve as a guide in the disposition of the split lengths 28, insuring that they are vertically located fully within the confines of that periphery. During this formation of the bottom layer 44, as well as during the formation of all subsequent layers 42, the configuration of the split lengths contributes to the assembly of a most compact and stable package. Since at least the majority of the split lengths include an arcuate, outer bark surface 30 intersecting with one or more substantially planar, split surfaces 32, it will be appreciated that in view of the random angular orientation of the various lengths in each layer, the planar surfaces 32 of most of the lengths 28 will either flushly engage the planar surface 32 of the laterally adjacent firewood length 28 or the arcuate bark surface 30** thereof. In the former instance, maximum compactness and resistance to angular displacement is assured while the latter instance likewise resists angular displacement, in view of the disparate texture between the two types of abutting surfaces.

Succeeding layers 42 are deposited atop the bottom layer 44 in the same manner as the first deposited layer and with each layer having he longitudinal axes of its split lengths 28 aligned normal to the next lower and higher layer as clearly depicted in FIGS. 1–5 of the drawings. Again, every layer 42 is positioned with the end surfaces 46 disposed in vertical planes coplanar with the respective peripheral surfaces of the bottom support member 14 or 22. The formation of the layers 42 continues as above, until the desired height or volume of the package is achieved. Following formation of the top layer 48, a plurality of pieces of kindling 50 may be deposited within the naturally formed crevices 52 created by the adjacently abutting split lengths 28.

Following the creation of the stack of densely arranged firewood lenghts 28 as above described, with or without the uppermost kindling 50, all of the stacked material is then encapsulated within a casing or envelope 54 comprising an open ended bag of well known shrink wrap material. This casing 54 as utilized, will be seen to comprise a planar top panel 56 integral with four substantially congruent side panels 58 terminating in a horizontal lower edge 60 defining a bottom opening 62. In horizontal cross-section, the casing 54 defines a square with equal sides slightly longer than the axial extent of the firewood lengths 28 or each peripheral surface 20, 36 so that the casing opening 62 will freely clear the stacked array 26 as the casing is lowered. The height of the casing is such that when fully lowered with the top panel 56 abutting the kindling 50 or top layer 46, the casing lower edge 60 will be disposed below the bottom support 14 or tray 22, whichever is lowermost.

The next step involves a final unitizing of the assembly including the casing and all structure as contained within its confines. This is accomplished by the application of dry heat to the surfaces of the casing panels 56, 58. Such heat may be applied manually, as by the heat gun 64 shown in FIG. 3, by one or more radiant heaters 66 as illustrated in FIG. 1 or by placing the complete assembly within an oven or heating chamber 68 as viewed in FIG. 4. Any well known transport means may be used to convey the assembly before and after the shrink wrap operation, such as a fork-lift truck (not shown) or the hand truck 70 of FIG. 5. During the heat application step, all portions of the casing material subjected to heat become constricted and as the panels shrink, the split lengths 28 and kindling 52 are tightly engaged and biased into a firm cohesive assembly, including the bottom tray 22 and/or pallet 14. This latter engagement is assured since the casing lower edge 60 extended below the bottom support when initially enveloped about the assembly and occurs unimpeded due to the lateral projection of the tray and pallet peripheries with respect to the periphery 36 of the underlying elevated platform 34.

Accordingly, it will be appreciated that the already closely arranged firewood lengths 28 are tightly biased together, both vertically and horizontally. This accurs as the casing panels 58 shrink vertically to bind the plurality of layers 42 together, with the top panel 56 and lower casing edge 60 grasp the upper and lower limits of the package 10 or 12. At the same time, the horizontal shrinking of the panels 58 produces a tight engagement between both end surfces 46 of all split lengths 28 as well as between the bark surfaces 30 of the two endmost lengths of each layer. The rigidity of the thusly produced packages is enhanced by the cross stacking of alternate layers so that an extremely stable assembly results.

As previously mentioned, the height or volume of any firewood package may be selected by forming variable numbers of the layers and then applying an appropriately sized casing. In this regards, FIG. 2 illustrates a package 12 comprising three cross-stacked layers 42 atop a retainer 14 and enveloped by a shrink wrapped casing 72. This casing may include a sling, handle or other carrying member 74 above its top panel 76. Such a package 12 containing relative few layers, with or without the inclusion of topmost kindling 50, 42 may be readily transported and will often serve the needs of one desiring an occasional fire or whose residence precludes the storage of larger quantities of firewood.

The foregoing is considered as illustrative only of the principles of the invention. Further, since numerous modifications and changes will readily occur to those skilled in the art, it is not desired to limit the invention to the invention to the exact construction and operation shown and described, and accordingly, all suitable modifications, and equivalents which may be resorted to, fall within the scope of the invention.

I claim:

1. A firewood package comprising;

a bottom support member having an outer periphery substantially defining a square, said bottom support member further comprising a first pair of cross members each having an outer cross member edge aligned with two opposing sides of the square, and a second pair of cross members each having an outer cross member edge aligned with another two opposing sides of the square, each of said first cross members fastened to each of said second cross members, a plurality of layers of substantially equal length firewood lengths disposed atop one another with a bottom most one said layer atop said bottom support member to provide a firewood stack, said firewood lengths having opposite end surfaces axially spaced from one another a distance substantially equal to the length of each side of said outer periphery of said square bottom support member, said firewood lengths in each said layer disposed adjacent to and parallel each other with all said end surfaces at each end of said length disposed in a vertical plane substantially flush with said outer periphery of said bottom support member, said firewood lengths in each said layer axially disposed in a direction normal to that of said firewood lengths in next adjacent ones of said layers to provide a cross-stacked assembly having a top most layer, a tray including upturned walls defining said outer periphery, said tray disposed atop said bottom support member and below said plurality of layers of firewood, and a shrink wrap casing surrounding said firewood stack and having top and bottom portions, said top portion closed and said bottom portion open, said portions respectively overlying said stack and underlying said bottom support member, whereby said shrink wrap casing horizontally biases inwardly against said firewood length and surfaces and vertically biases said top layer toward said bottom support member to provide a stable, unitized package.

2. A firewood package according to claim 1, including;

handle means on said shrink wrap casing disposed above said top most layer.

* * * * *